US008297072B2

(12) United States Patent
Willcoxen et al.

(10) Patent No.: US 8,297,072 B2
(45) Date of Patent: Oct. 30, 2012

(54) CONTAINER INCORPORATING INTEGRAL COOLING ELEMENT

(75) Inventors: Mark Alan Willcoxen, Lakewood, CO (US); Daniel Alan Thieman, Toronto (CA)

(73) Assignee: MillerCoors, LLC, Golden, CO (US)

( * ) Notice: Subject to any disclaimer, the term of this patent is extended or adjusted under 35 U.S.C. 154(b) by 1002 days.

(21) Appl. No.: 12/249,431

(22) Filed: Oct. 10, 2008

(65) Prior Publication Data

US 2009/0094994 A1 Apr. 16, 2009

Related U.S. Application Data

(60) Provisional application No. 60/980,197, filed on Oct. 16, 2007.

(51) Int. Cl.
*F25D 3/08* (2006.01)

(52) U.S. Cl. ..... 62/457.3; 62/530

(58) Field of Classification Search ..... 62/371, 62/457.3, 457.4, 457.7, 530
See application file for complete search history.

(56) References Cited

U.S. PATENT DOCUMENTS

| | | | |
|---|---|---|---|
| 2,652,148 | A | 9/1953 | Pfeifer |
| 3,494,142 | A | 2/1970 | Beck |
| 3,525,236 | A | 8/1970 | Solhkhah |
| 3,760,972 | A | 9/1973 | McKirnan |
| 3,852,975 | A | 12/1974 | Beck |
| 3,913,770 | A | 10/1975 | Tarro |
| 4,554,189 | A | 11/1985 | Marshall |
| 4,628,703 | A | 12/1986 | Kim |
| 4,671,406 | A | 6/1987 | Baer |
| 4,736,599 | A | 4/1988 | Siegel |
| 4,761,314 | A | 8/1988 | Marshall |
| 4,784,678 | A | 11/1988 | Rudick et al. |
| 4,802,343 | A | 2/1989 | Rudick et al. |
| 4,982,722 | A | 1/1991 | Wyat |
| 5,168,708 | A | 12/1992 | Siegel |
| 5,499,460 | A | 3/1996 | Bryant et al. |
| 5,520,103 | A | 5/1996 | Zielinski et al. |
| 5,543,186 | A | 8/1996 | Andersen et al. |
| 5,637,389 | A | 6/1997 | Colvin et al. |
| 5,718,352 | A | 2/1998 | Diekhoff et al. |
| 5,762,230 | A | 6/1998 | Policappelli |
| 5,928,741 | A | 7/1999 | Andersen et al. |
| 5,952,068 | A | 9/1999 | Neale et al. |

(Continued)

FOREIGN PATENT DOCUMENTS

EP 0931998 7/1999

(Continued)

OTHER PUBLICATIONS

U.S. Appl. No. 12/249,356, filed Oct. 10, 2008, Kelly, et al.

(Continued)

*Primary Examiner* — Melvin Jones
(74) *Attorney, Agent, or Firm* — Sheridan Ross P.C.

(57) ABSTRACT

A beverage container is provided with an integral cooling element to maintain a beverage at a cooled temperature after exposure to a warmer environment. The cooling element incorporates use of solid/liquid phase change material. When the beverage is chilled, the phase change material is maintained in a solid state below its melting temperature. When the beverage container is exposed to a warmer environment, such as during consumption, the phase change material undergoes a phase change thereby absorbing heat from the surrounding beverage. The cooling element can either be attached to the inside of the container or free-floating, but in either case, is in direct contact with the beverage.

13 Claims, 4 Drawing Sheets

U.S. PATENT DOCUMENTS

| | | | |
|---|---|---|---|
| 6,065,634 | A | 5/2000 | Brifcani et al. |
| 6,103,280 | A | 8/2000 | Molzahn et al. |
| 6,109,006 | A | 8/2000 | Hutchinson |
| 6,141,970 | A | 11/2000 | Molzahn et al. |
| 6,151,911 | A | 11/2000 | Dando et al. |
| 6,173,579 | B1 | 1/2001 | Davidson |
| 6,341,491 | B1 | 1/2002 | Paine et al. |
| 6,387,482 | B1 | 5/2002 | Persiani et al. |
| 6,415,940 | B1 | 7/2002 | Brabson, II |
| 6,419,108 | B1 | 7/2002 | Toida et al. |
| 6,422,024 | B1 | 7/2002 | Foye |
| 6,474,498 | B1 | 11/2002 | Markham |
| 6,551,638 | B1 | 4/2003 | Dodd et al. |
| 6,829,902 | B1 | 12/2004 | Claydon |
| 6,852,381 | B2 | 2/2005 | Debraal et al. |
| 7,074,466 | B2 | 7/2006 | DeBraal et al. |
| 7,124,604 | B2 | 10/2006 | Taylor et al. |
| 7,176,426 | B2 | 2/2007 | Ramirez |
| 7,431,174 | B2 | 10/2008 | Thissen |
| 7,802,446 | B2 | 9/2010 | Overgaard |
| 2002/0150657 | A1 | 10/2002 | Farr et al. |
| 2002/0164474 | A1 | 11/2002 | Buckley |
| 2004/0105923 | A1 | 6/2004 | O'Connell |
| 2004/0109928 | A1 | 6/2004 | O'Connell |
| 2004/0255787 | A1* | 12/2004 | Lassota et al. ..... 99/275 |
| 2005/0147778 | A1 | 7/2005 | Tai et al. |
| 2005/0196629 | A1 | 9/2005 | Bariatinsky et al. |
| 2005/0199057 | A1 | 9/2005 | Hadala |
| 2005/0258250 | A1 | 11/2005 | Melick et al. |
| 2006/0038293 | A1 | 2/2006 | Rueger et al. |
| 2006/0054622 | A1 | 3/2006 | Agnello |
| 2006/0063000 | A1 | 3/2006 | Tokumara et al. |
| 2006/0073298 | A1 | 4/2006 | Hutchinson et al. |
| 2006/0086745 | A1 | 4/2006 | Morrison |
| 2006/0147696 | A1 | 7/2006 | Crowley |
| 2006/0153956 | A1 | 7/2006 | Ullmann |
| 2006/0156756 | A1* | 7/2006 | Becke ..... 62/457.3 |
| 2006/0182165 | A1 | 8/2006 | Tapelt-Glaser |
| 2006/0182372 | A1 | 8/2006 | Fadal et al. |
| 2006/0185372 | A1 | 8/2006 | Conde Hinojosa |
| 2006/0186125 | A1 | 8/2006 | Tew |
| 2006/0249949 | A1 | 11/2006 | Fortune |
| 2006/0280843 | A1 | 12/2006 | Jager et al. |
| 2007/0000484 | A1 | 1/2007 | Magill et al. |
| 2007/0059837 | A1 | 3/2007 | Heilmann et al. |
| 2007/0071680 | A1 | 3/2007 | Ribi |
| 2007/0138289 | A1 | 6/2007 | Melick et al. |
| 2007/0212501 | A1 | 9/2007 | Wolfe et al. |
| 2008/0043804 | A1 | 2/2008 | Goldsmith et al. |
| 2008/0121728 | A1 | 5/2008 | Rodriguez |
| 2008/0271476 | A1 | 11/2008 | Langguth |
| 2009/0305397 | A1 | 12/2009 | Dodgson et al. |
| 2011/0185764 | A1 | 8/2011 | Kelly |

FOREIGN PATENT DOCUMENTS

| | | |
|---|---|---|
| EP | 1780147 | 5/2007 |
| GB | 2347202 | 8/2000 |
| GB | 2365106 | 2/2002 |
| GB | 2370629 | 7/2002 |
| JP | 2007-090071 | 4/2007 |
| WO | WO 95/04709 | 2/1995 |
| WO | WO 97/24968 | 7/1997 |
| WO | WO 2004/022435 | 3/2004 |
| WO | WO 2004/037888 | 5/2004 |
| WO | WO 2005/102668 | 11/2005 |

OTHER PUBLICATIONS

U.S. Appl. No. 12/251,140, filed Oct. 14, 2008, Kelly, et al.

"Phase Change Material", Answers.com (Technology), available at http://www.answers.com/topic/phase-change-material-1?cat=technology, printed on Aug. 29, 2007, pp. 1-2.

"Encapsulated Phase Change Materials", microtek Laboratories, Inc., available at http://www.microteklabs.com/phasechange.html, printed on Aug. 29, 2007, p. 1.

"Micro PCM's", microtek Laboratories, Inc., available at http://www.microteklabs.com/micropcm.html, printed on Aug. 29, 2007, p. 1.

"n-Paraffin Technical Data Sheet (Complex Normal Paraffin)", microtek Laboratories, Inc., available at http://www.microteklabs.com/table.html, printed on Aug. 29, 2007, p. 1.

International Search Report for International (PCT) Patent Application No. PCT/US08/79685, mailed Dec. 16, 2008.

Written Opinion for International (PCT) Patent Application No. PCT/US08/79685, mailed Dec. 16, 2008.

International Preliminary Report on Patentability for International (PCT) Patent Application No. PCT/US08/79685, mailed Apr. 29, 2010.

U.S. Appl. No. 13/042,112, filed Mar. 7, 2011, Kelly.

Heilman, "Camera Phone Based Indicator," Research and Development Activities in Printed Intelligence, H. Kopola, ed., 2009, VTT Technical Research Center of Finland, pp. 26-27, available at http://130.188.4.36/files/download/scientific_reports/cpi_09_review.pdf#page=27.

* cited by examiner

CONTAINER INCORPORATING INTEGRAL COOLING ELEMENT

CROSS REFERENCE TO RELATED APPLICATIONS

Priority is claimed from U.S. Provisional Patent Application No. 60/980,197 filed on Oct. 16, 2007 and entitled "CONTAINER INCORPORATING INTEGRAL COOLING ELEMENT", the disclosure of which is incorporated herein by reference in its entirety.

FIELD OF THE INVENTION

The present invention relates to beverage containers with integral cooling capabilities, and more particularly, to a container incorporating a cooling element in the form of phase change material placed within the container to maintain the beverage within the container at desired temperatures.

BACKGROUND OF THE INVENTION

Portable beverage containers are used to hold many types of beverages to include carbonated soft drinks, fruit drinks, and beer. Many of these beverages are preferably consumed at relatively cold temperatures, for example, between 36° F. and 50° F. For carbonated soft drinks and beer, it is important to maintain the beverage at cold temperatures otherwise consumers may prefer not to consume the beverage. Traditional chilling or cooling techniques include placing the containers in a chilled environment such as a refrigerator or cooler, and then serving the beverage once the beverage has reached a desired chilled temperature.

When the beverage is removed from the chilled environment, the beverage begins to quickly warm due to a combination of external heat sources including ambient heat of the surrounding environment, contact with warm surfaces such as the consumer's hand or the surface on which the container is placed, as well as radiant heat from the sun or other light sources. Heat transfer takes place through the walls, base, and top of the container to the beverage. Without some means provided for insulating the container, the beverage quickly warms and, in many circumstances, it becomes undesirable or unfit for consumption.

There are a number of inventions that have been developed for purposes of insulating a beverage within the container such that it is maintained at a desired temperature prior to consumption. For example, it is well known to provide external thermal barriers such as an insulated sleeve that is applied over the exterior sidewall of the container. It is also known to provide an insulated label on the exterior sidewall of the container. There are a number of disadvantages to these traditional methods of insulating beverages. An insulating label or sleeve only covers the container sidewall, therefore leaving the bottom of the container exposed. For insulated labels, they are typically much thicker than a non-insulated label and a standard packaging line may have to be substantially modified to accommodate these special labels. For insulated sleeves, these require the consumer to maintain a separate component to maintain the beverage at a desired cold temperature and many times a consumer will not be at a location where the insulated sleeves are stored.

Some efforts have also been made to provide an internal insulating liner for containers. One example is disclosed in U.S. Pat. No. 6,474,498. This reference provides a thermally insulated container for canned beverages including a lining formed from a plastics material. The preferred embodiment suggests using a plastic closed cell material to include closed cell materials similar to bubble wrap. The liner is intended to be placed into the container as by a slideable fit so as to be in contact with the cylindrical inner surface of the container wall.

In addition to externally mounted sleeves and internal liners, some efforts have also been made to maintain beverages at a desired temperature by use of phase change material that is placed within the container. Upon warming, the phase change material changes phase to help maintain the beverage at a cooler temperature for a period of time in which the consumer would normally consume the beverage.

Phase change materials are substances with a high heat of fusion. These materials are capable of storing or releasing large amounts of energy. Phase change materials used for containers are solid/liquid change phase materials wherein the phase change material changes phase from solid to liquid at the material's melting point. More specifically, when the beverage is maintained in a chilled environment below the melting or phase change temperature, the phase change material remains in a solid state. When the container is removed from the chilled environment during consumption of the beverage, the phase change material absorbs a relatively large amount of heat without a significant rise in temperature. Thus, phase change material absorbs heat from the surrounding beverage in the container thereby keeping the beverage at the preferred drinking temperature longer.

One reference disclosing use of phase change material in a container includes the British Patent GB2370629. A phase change material is contained in a small chamber such as a tube placed inside the container. The phase change material is activated when the user opens the can. The phase change material is preferably a liquid, such as water, that boils or vaporizes in the tube. A lower pressure area or vacuum in the tube allows the phase change material to vaporize. Upon vaporization, heat is transferred from the beverage to the tube containing the phase change material.

International Publication WO9724968 discloses a self-cooling food or beverage contained in which a phase change capsule, when activated, results in heat exchange contact with the surrounding or adjacent food or beverage container.

U.S. patent application Publication No. 2006/0156756 discloses a self-cooling food or beverage container wherein the container has inner and outer walls and phase change material is located in the space between the walls.

While the foregoing references may be adequate for their intended purpose, there is still a need for providing a cooling element that can be used with a container wherein the cooling element can be easily incorporated into standard manufacturing and production lines without significant alteration to these processes. Furthermore, there is still a need to provide a cooling element for a container wherein the cooling element can be manufactured and installed at a relatively low cost so that the ultimate retail price of a container is still competitive with containers not incorporating cooling capabilities.

SUMMARY OF THE INVENTION

In accordance with the present invention, it is one object of the present invention to provide a beverage container with an integral cooling element that can effectively and safely maintain a beverage at a desired temperature during consumption of the beverage.

It is yet another object of the present invention to provide a cooling element incorporated within a beverage container wherein the cooling element can be added to the container without substantially modifying standard manufacturing and production processes.

It is yet another object of the present invention to provide a cooling element for a beverage container that may be applied to many different types of beverage containers, such as those made from metal or plastic.

It is yet another object of the present invention to provide a cooling element that can be placed within the container having a relatively small size that takes up a minimum volume within the container. The cooling element therefore preferably has a minimum profile that is not intrusive to a user who consumes the beverage.

In accordance with the present invention, a beverage container is provided with a cooling element that is capable of keeping the container at a desired chilled temperature after the container has been removed from a chilled environment. The cooling element makes use of solid/liquid phase change material contained within an outer protective shell to prevent contact of the phase change material with the beverage within the container. In the chilled environment, the phase change material is in a solid phase. When the container is exposed to the warmer environment, the phase change material absorbs heat during its phase change, keeping the surrounding beverage at a cooler temperature over a longer period of time as compared to the temperature of the beverage without use of the phase change material.

In one preferred embodiment of the present invention, the cooling element is sized to fit within the open top of an unfinished container and the cooling element has features that allow the cooling element to be secured to the bottom or side of the container without use of an adhesive. In yet another embodiment of the present invention, the cooling element includes phase change material encapsulated within a flexible plastic film pouch or bag, and the particular size and shape of the film covering can be adapted for use with many different types of containers.

One preferred type of phase change material includes a paraffin wax compound having a phase change transition temperature at 6° C. The phase change material is maintained in a solid state when the beverage is chilled below its melting temperature. When the container is removed from the chilled environment, the phase change material absorbs heat from the beverage within the container during the phase change thereby maintaining the temperature of the beverage cooler. While a paraffin wax type phase change material is acceptable for use in the present invention, other phase change materials may be used to include other wax derivatives or hydrated solids. Further, phase change materials may be provided in combinations wherein the respective melting point temperatures of the phase change materials are different. Accordingly, the cooling element provides cooling of the surrounding beverage over a longer period of time after the beverage continues to warm in response to exposure to the warmer environment.

In the preferred embodiments, the cooling element is relatively small and therefore does not materially affect the amount of beverage that can be placed within standard sized containers. The volume of the cooling element can be compensated for by slightly reducing the amount of headspace and/or the volume of the beverage within the container.

As discussed further below, some of the preferred embodiments secure the cooling element to the base of the container thereby minimizing the consumer's ability to observe the cooling element. In some instances, a consumer may dislike viewing the cooling element that otherwise distracts the consumer's ability to fully enjoy the beverage. The presence of the cooling element may be viewed as an undesirable foreign article in the beverage if it interferes with the consumer's normal interaction with the container.

The objects of the present invention and the associated advantages thereof will become more readily apparent from the following detailed description taken in conjunction with the following drawings.

DETAILED DESCRIPTION

Figure 1:
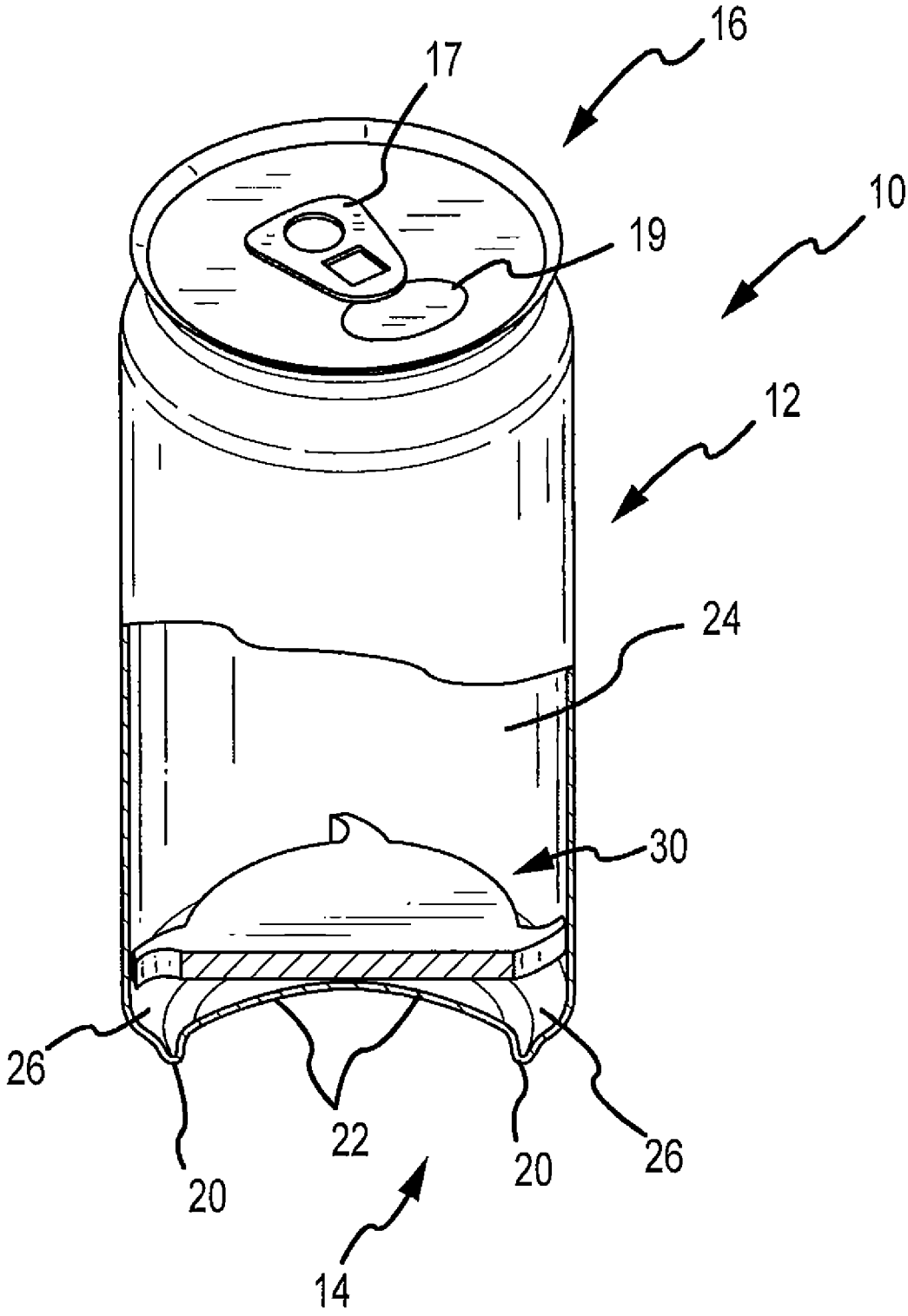
FIG. 1 is a fragmentary perspective view of a container incorporating a cooling element in accordance with the first embodiment of the present invention.

Referring to FIG. 1, a beverage container 10, particularly suited for beverages such as beer or carbonated soft drinks, is shown. The container is illustrated as a conventional beverage can having a sidewall or body 12, a base 14, and an openable top 16. The openable top 16 may include a closure mechanism, such as a pull-tab 17. The sidewall or body of the container is constructed of conventional material such as aluminum or steel. The closure mechanism 17 is also preferably aluminum or steel and may include the pull-tab 17 that contacts a scored area 19 on the top 16. Activation of the pull-tab breaks the scored area creating an opening or mouth to provide access to the beverage inside the container. As also shown in FIG. 1, the base 14 may have an annular lip 20 and a dome shaped panel 22. A peripheral concave or curved area 26 resides between the lip 20 and the cylindrical sidewall.

Figure 2:
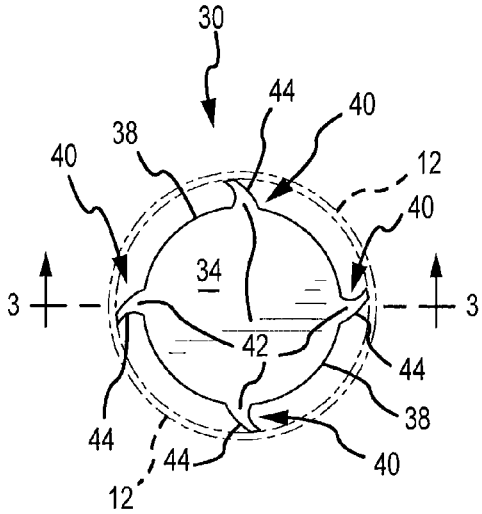
FIG. 2 is a plan view of the cooling element showing its relative size with respect to the diameter of the container and the manner in which the cooling element can engage the sidewalls of the container to maintain the cooling element at a desired position within the container.
Figure 3:
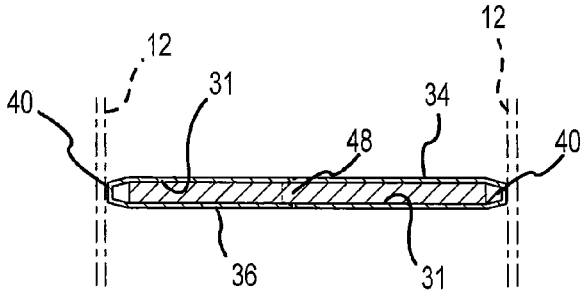
FIG. 3 is an enlarged cross section taken along line 3-3 of FIG. 2.

In accordance with a first embodiment of the present invention and also referring to FIGS. 2 and 3, the container incorporates a cooling element 30. The cooling element has an outer shell 31 or covering that encapsulates a quantity of phase change material 48 therein. As shown in the figure, the shell is very thin thereby minimizing any thermal insulation properties that would inhibit absorption of heat by the phase change material when the container is exposed to the warmer environment. In this first embodiment, the shape or configuration of the cooling element is provided such that it can be placed at a selected location within the container and maintained at that location without the requirement to use an adhesive to secure the element. The cooling element has a low profile defined by a very small thickness as compared to the overall height of the container. Thus, the cooling element is a very non-obtrusive element that does not interfere with the normal flow of beverage from the container when the beverage is consumed. This low profile also makes the cooling element more difficult to view by the consumer when the cooling element is secured adjacent to or in the base of the container thereby limiting any distractions that could be associated with the viewing of the cooling element As shown in FIGS. 2 and 3, the cooling element 30 has a disc shaped body with an upper surface 34, a lower surface 36, and a peripheral edge 38. Extending from the peripheral edge 38 are a plurality of fins or extensions 40 that make contact with the interior surface 24 of the sidewall. In this embodiment, the lower surface 36 also preferably maintains contact with the interior surface of the dome 22. The extensions 40 are preferably made of the same material as the outer shell, and are flexible and resilient such that the extensions 40 maintain frictional contact with the interior surface 24. One preferred shape for the extensions are shown as curved members having pointed distal tips 44 and enlarged base portions 42 that connect to the body of the cooling element.

During production, the cooling element 30 may be installed by a cylindrical shaped mandrel (not shown). The mandrel may be inserted within the open top of the container. When the mandrel is removed, the spring action of the extensions 40 keeps the cooling element in place within the container by frictional engagement of the extensions 40 against the interior surface 24 of the sidewall.

While the fin shaped extensions are shown in this particular embodiment, it shall be understood that other shaped extensions may be provided to achieve the same purpose, namely, maintaining frictional engagement with the interior surface of the container thereby holding the widget in place without the requirement for use of an adhesive.

Referring to FIG. 3, the phase change material 48 fills the body. However, the fin shaped extensions 40 preferably do not have phase change material therein.

Figure 4:
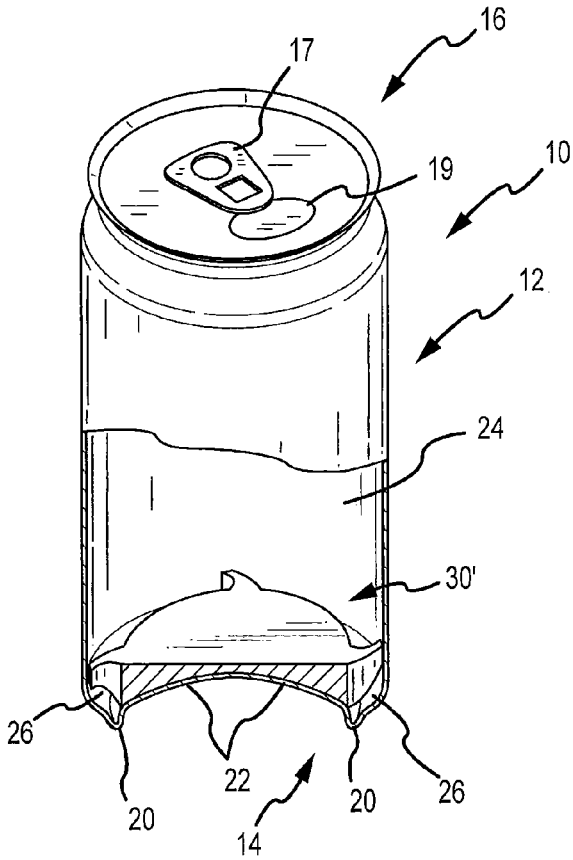
FIG. 4 is another fragmentary perspective view similar to FIG. 1, but illustrating the cooling element in a different configuration wherein the cooling element conforms to the lower dome of the container.

Referring to FIG. 4, a slightly different configuration is provided for the cooling element of the first embodiment wherein the cooling element 30' has a curved shape body that conforms to the dome shaped panel 22. The fin shaped extensions, however, still extend away from the body so that they extend substantially orthogonal or perpendicular with respect to the sidewall of the container.

Figure 5:
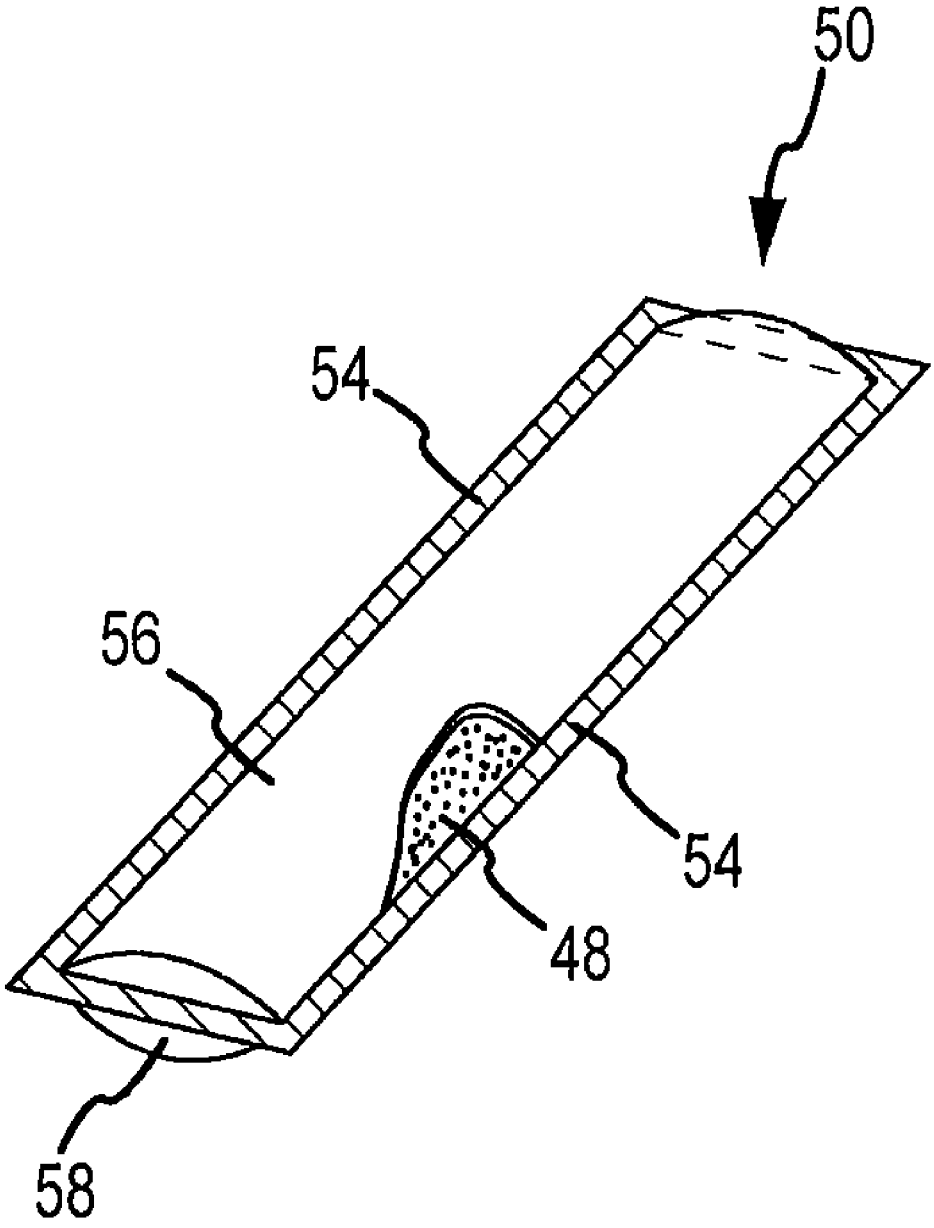
FIG. 5 is a fragmentary perspective view of a cooling element in another embodiment of the present invention wherein the phase change material is held within a flexible plastic film pouch.

Referring to FIG. 5, another embodiment of the present invention is illustrated wherein a cooling element 50 is a pouch or pocket having phase change material 48 therein. More specifically, the cooling element 50 may include an upper surface 56 formed from a first sheet of flexible plastic film and a lower surface 58 made from a second sheet of flexible plastic film. The two sheets of film material are sealed to one another along an exterior edge 54 of the pouch. In FIG. 5, a substantially rectangular shaped pouch is shown. However, it shall be understood that the pouch may be configured in many different shapes to include round, or even a donut shaped pouch that frictionally engages the sidewalls of the container. In this second embodiment, the use of a flexible pouch containing the phase change material is very adaptable for placement into many different types and shapes of containers. The pouch may be shaped and sized to best accommodate the type of container that is to receive the cooling element.

Figure 6:
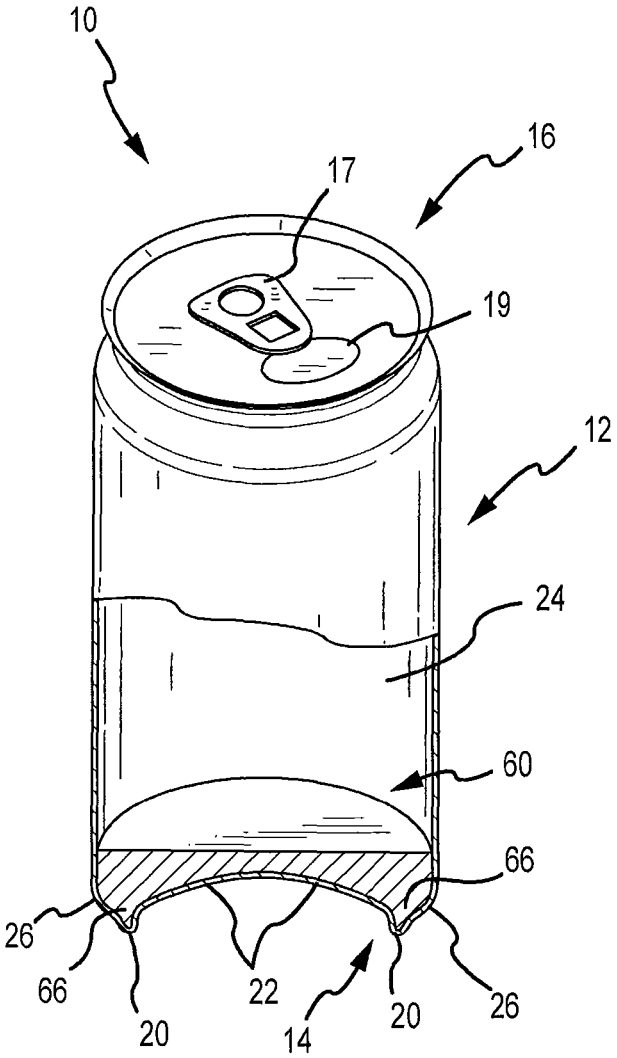
FIG. 6 is a fragmentary perspective view of a container incorporating a cooling element in accordance with another embodiment of the present invention wherein the cooling element more fully conforms to the bottom portion of the container.

Referring to FIG. 6, another embodiment is illustrated wherein a cooling element 60 more fully conforms to the dome shaped panel 22 of the base 14. As shown, the cooling element 60 has a generally flat upper surface and a curved lower surface in contact with the dome shaped panel. The curved peripheral edge 66 of the cooling element generally conforms to the lip 20. With this nested arrangement of the cooling element 60, the cooling element conveniently rests on the dome shaped panel and, is prevented from freely shifting within the container. As with the prior embodiments, the cooling element 60 contains a desired phase change material therein.

Figure 7:
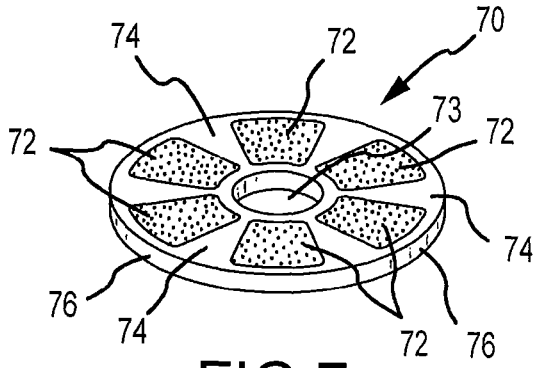
FIG. 7 is perspective view of another cooling element in accordance with another embodiment of the present invention.

Referring to FIG. 7, another configuration for a cooling element is shown in the form of a cooling element assembly 70. This assembly 70 comprises a plurality of individual cooling elements 72 set within a supporting frame. As shown, the individual cooling elements 72 are separated from one another by radial arms 74 of the frame that extends from a central area 73. The peripheral edge 76 of the frame is sized to frictionally engage the interior sidewall of the container. Each of the cooling elements 72 has an exterior shell with encapsulated phase change material therein. Although this figure shows a cooling element residing in each gap between arms 74 of the frame, it shall be understood that a selected level of cooling may be obtained by simply choosing the number of cooling elements to be incorporated in the cooling element assembly. The frame having a continuous peripheral edge as well as the radial arms or spokes helps to create sufficient rigidity for the cooling element assembly so that it does not randomly shift within the container.

Figure 8:
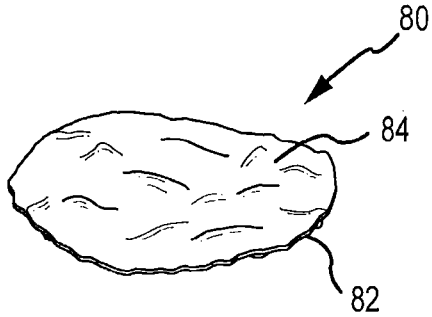
FIG. 8 is a perspective view of yet another cooling element in accordance with another embodiment of the present invention.

Referring to FIG. 8, another cooling element 80 is shown wherein the cooling element has an irregular shaped body 84 characterized by ruffled or uneven surfaces. A peripheral edge 82 of the cooling element forms a generally circular closed shape. This cooling element 80 can be sized so that at least some portions of the peripheral edge 82 contact the interior surface of the container thereby frictionally holding the cooling element in place. As with the other embodiments, an outer shell or covering of the cooling element houses a quantity of phase change material therein.

Figure 9:
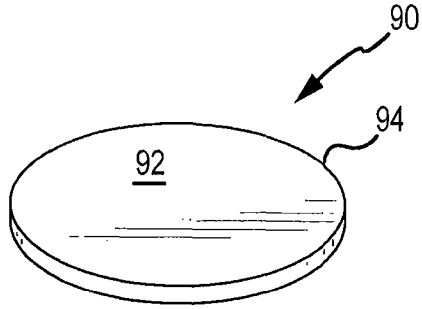
FIG. 9 is a perspective view of yet another cooling element in accordance with another embodiment of the present invention.

Referring to FIG. 9, yet another cooling element 90 is shown wherein the cooling element has a disc shaped body 92 sized to fit within the desired container. Accordingly, the peripheral edge 94 frictionally engages the interior surface of the container sidewall. The cooling element 90 also has an outer shell that houses a quantity of phase change material therein.

In each of the embodiments of the present invention, it is contemplated that one or more phase change materials may be used to maintain cooling for the particular beverage. For beverages that may take a consumer longer to consume, it may be beneficial to provide two or more different types of phase change material wherein the phase change for each material occurs at different temperatures so as the beverage continues to warm, the different phase change materials absorb heat over a greater range of temperatures and over a greater period of time.

One commercially available manufacturer of phase change materials is MicroTek Laboratories, Inc. of East River Road, Dayton, Ohio. As mentioned above, two acceptable types of phase change materials may include various paraffin complexes, as well as hydrated salts.

One particular phase change material sold by MicroTek Laboratories, Inc. is MPCM. MPCM is an encapsulated paraffin wax (heat capacity of 188.6 J/g) in a polymer shell with a solid to liquid phase change temperature of 6° C. When chilled to below 6° C., the paraffin exists as a solid. As the encapsulated paraffin wax absorbs heat, the paraffin wax rises in temperature until it reaches 6° C. At that temperature, the paraffin wax continues to absorb heat but stays at a relatively constant temperature until it has completely transitioned from a solid to a liquid phase. The heat absorbed by the phase change (latent heat) helps to maintain the beverage at a cooler temperature.

The total amount of heat required to be absorbed in order to maintain the beverage at a desired chilled temperature can be calculated and adjusted based upon the amount of phase change material being used. In this example, 25 cc of MPCM absorbs the equivalent heat that would otherwise cause a 5° F. increase in the temperature of a 355 cc beverage.

The cooling element in the embodiments is preferably relatively small and therefore does not materially affect the amount of beverage that can be placed within standard sized containers. As mentioned, the volume of the cooling element can be compensated for by slightly reducing the amount of headspace and/or the volume of the beverage within the container. As also mentioned, some of the preferred embodiments secure the cooling element to the base of the container thereby minimizing the consumer's ability to observe the cooling element and therefore minimizing any distractions a consumer may associate with the presence of the cooling element.

While the present invention has been disclosed above with respect to cooling elements having particular size or configuration, it shall be understood that other shapes and sizes of the cooling elements can be provided, the only relevant limitation being that the cooling element should be large enough to prevent the widget from passing through the container opening. Thus, while it may be preferable to provide a widget that frictionally engages the sidewalls or base of the container, it is also contemplated that the widget could be free floating within a container. Depending upon the density of the widget, it could therefore either float near the surface of the beverage or sink to the base.

In each of the embodiments of the present invention, it is also important to use materials that are compatible with the particular beverage and container such that there are no adverse chemical reactions that take place including reactions or mere exposure that may alter the flavor of the beverage. Further, in the event that the outer protective shell or covering of the cooling element breaks or is otherwise compromised, it is also important to make use of phase change material that is also non-toxic and cannot harm the consumer. It is also desirable to provide a shell or casing material that is non-reactive with the beverage, and is also a barrier that prevents migration of phase change material into the beverage, and vise versa. Thus, the shell material should be non-permeable with respect to the beverage in the container.

While the preferred embodiments of the present invention have been shown specifically with respect to a traditional aluminum or steel container, it shall be understood that the cooling element can be incorporated within any type of container to include plastic containers, such as PET bottles or conventional aluminum or steel cans used to contain other products such as juices, fruits and vegetables.

While the present invention has been described above with respect to various preferred embodiments, it shall be understood that various other changes and modifications to the invention may be made, commensurate with the scope of the claims appended hereto.

What is claimed is:

1. A beverage container with integral cooling capability, said container comprising:

a sidewall, a base connected to the sidewall, and a top forming an upper portion of the container;

a cooling element placed within the container and at least contacting an interior surface of the sidewall or base, said cooling element comprising a body containing phase change material therein wherein the phase change material undergoes a phase change from a solid to a liquid when absorbing heat from a beverage in the container; and said body further includes a plurality of extensions extending away from said peripheral edge and said extensions contacting said interior surface of the sidewall.

2. A container, as claimed in claim 1, wherein:

said extensions are fin shaped.

3. A container, as claimed in claim 1, wherein:

said extensions each include a base portion connected to said body of the cooling element and a pointed distal tip extending from the base portion, said distal tip contacting said interior surface of the sidewall.

4. A beverage container with integral cooling capability, comprising:

a sidewall, a base connected to the sidewall, and a top forming an upper portion of the container;

a cooling element placed within the container and at least contacting an interior surface of the sidewall or base, said cooling element comprising a body containing phase change material therein wherein the phase change material undergoes a phase change from a solid to a liquid when absorbing heat from a beverage in the container; and wherein said phase change material includes at least two different phase change materials and wherein each phase change material has a different melting point.

5. A container, comprising:

a sidewall, a base connected to the sidewall, and a top forming an upper portion of the container;

a cooling element placed within the container and at least contacting an interior surface of the sidewall or base, said cooling element comprising a body containing phase change material therein wherein the phase change material undergoes a phase change from a solid to a liquid when absorbing heat from a beverage in the container; and said body of said cooling element has upper and lower surfaces, and said lower surface being curved shape to conform to an exterior dome shaped panel of said base of said container.

6. A beverage container, comprising:

sidewall, a base connected to the sidewall, and a top forming an upper portion of the container;

a cooling element placed within the container and at least contacting an interior surface of the sidewall or base, said cooling element comprising a body containing phase change material therein wherein the phase change material undergoes a phase change from a solid to a liquid when absorbing heat from a beverage in the container;

said body has an irregular shaped peripheral edge, and irregular shaped upper and lower surfaces.

7. A beverage container, comprising:

sidewall, a base connected to the sidewall, and a top forming an upper portion of the container;

a cooling element placed within the container and at least contacting an interior surface of the sidewall or base, said cooling element comprising a body containing phase change material therein wherein the phase change material undergoes a phase change from a solid to a liquid when absorbing heat from a beverage in the container;

said cooling element has a disc shaped body and said body has a circular shaped peripheral edge that contacts said interior surface of said sidewall.

8. A beverage container with integral cooling capability, said container comprising:

a sidewall, a base connected to the sidewall, and a top forming an upper portion of the container;

a cooling element placed within the container and at least contacting an interior surface of the sidewall or base, said cooling element comprising first and second sheets of flexible plastic film sealed to one another along a peripheral edge, and phase change material encapsulated therein.

9. A container, as claimed in claim 8, wherein:

said flexible plastic film is non-permeable and prevents migration of the beverage within the beverage container from contacting the phase change material.

10. A method of maintaining a beverage within the container at a desired temperature, said method comprising the steps of:

providing a beverage container having an interior surface;

placing a cooling element within the container wherein the container holds a beverage in direct contact with the cooling element, said cooling element having a phase change material;

maintaining the beverage in a cooler environment wherein the phase change material is maintained in a solid state;

removing the beverage from the cooler environment to a warmer environment, such as when a consumer is consuming the beverage; and wherein said phase change material undergoes a phase change from a solid to a liquid and the phase change material absorbs heat from the surrounding beverage within the container thereby maintaining the beverage at a cooler temperature during the phase change; and wherein said phase change material includes at least two different phase change materials, each having different melting point temperatures.

11. A beverage container with integral cooling capability, said container comprising:

a sidewall, a base connected to the sidewall, and a top forming an upper portion of the container;

a cooling element placed within the container and at least contacting an interior surface of the sidewall or base, said cooling element comprising a frame with a plurality of gaps formed between extensions of the frame, and a plurality of phase change elements secured between said gaps, said phase change elements having an outer protective covering and phase change material placed therein, said frame having a peripheral edge that contacts an interior surface of the sidewall.

12. A beverage container, as claimed in claim 11, wherein:

said outer covering is non-permeable with respect to the beverage thereby preventing migration of the beverage into the cooling element.

13. A beverage, as claimed in claim 1, wherein:

said phase change material is selected from the group consisting of paraffin-based waxes and hydrated salts.

* * * * *